US010816194B2

(12) United States Patent
Seeley

(10) Patent No.: US 10,816,194 B2
(45) Date of Patent: Oct. 27, 2020

(54) RADIANT BURNER

(71) Applicant: Edwards Limited, Burgess Hill, West Sussex (GB)

(72) Inventor: Andrew James Seeley, Clevedon (GB)

(73) Assignee: Edwards Limited, Burgess Hill, West Sussex (GB)

( * ) Notice: Subject to any disclaimer, the term of this patent is extended or adjusted under 35 U.S.C. 154(b) by 168 days.

(21) Appl. No.: 15/563,294

(22) PCT Filed: Mar. 23, 2016

(86) PCT No.: PCT/GB2016/050828
§ 371 (c)(1),
(2) Date: Sep. 29, 2017

(87) PCT Pub. No.: WO2016/156813
PCT Pub. Date: Oct. 6, 2016

(65) Prior Publication Data

US 2018/0073732 A1 Mar. 15, 2018

(30) Foreign Application Priority Data

Mar. 30, 2015 (GB) ..... 1505447.1
Mar. 23, 2016 (GB) ..... 1604942.1

(51) Int. Cl.
*F23D 14/16* (2006.01)
*F23G 7/06* (2006.01)

(52) U.S. Cl.
CPC ..... *F23D 14/16* (2013.01); *F23G 7/063* (2013.01); *F23G 2204/20* (2013.01); *F23G 2204/203* (2013.01)

(58) Field of Classification Search
CPC ..... F23G 7/06; F23D 14/16
(Continued)

(56) References Cited

U.S. PATENT DOCUMENTS 5,603,905 A * 2/1997 Bartz ..... F23D 14/16 110/236
6,234,787 B1 * 5/2001 Endoh ..... F23G 7/065 431/353

(Continued)

FOREIGN PATENT DOCUMENTS

CN 200967298 Y 10/2007
CN 101493224 A 7/2009

(Continued)

OTHER PUBLICATIONS

Prosecution history of corresponding Chinese Application No. CN201680019987.9 including: First Office Action dated Nov. 5, 2018 and Chinese Search Report dated Oct. 26, 2018.

(Continued)

*Primary Examiner* — Edelmira Bosques
*Assistant Examiner* — Nikhil P Mashruwala
(74) *Attorney, Agent, or Firm* — Theodore M. Magee; Westman, Champlin & Koehler, P.A.

(57) ABSTRACT

A radiant burner for treating an effluent gas stream from a manufacturing processing tool includes: a porous sleeve at least partially defining a treatment chamber and through which treatment materials pass for introduction into the treatment chamber; and an electrical energy device coupled with the porous sleeve and operable to provide electrical energy to heat the porous sleeve which heats the treatment materials as they pass through the porous sleeve into the treatment chamber. In this way, electrical energy, rather than combustion, is used to raise the temperature within the treatment chamber in order to treat the effluent gas stream.

15 Claims, 3 Drawing Sheets

(58) Field of Classification Search
USPC ..... 431/5
See application file for complete search history.

(56) References Cited

U.S. PATENT DOCUMENTS

| | | | | |
|---|---|---|---|---|
| 7,045,703 | B2 * | 5/2006 | Nakayama | F23D 14/125 136/253 |
| 7,116,900 | B2 * | 10/2006 | Johnson | F23C 3/002 392/407 |
| 7,569,193 | B2 * | 8/2009 | Ferron | B01D 53/34 422/168 |
| 7,700,049 | B2 * | 4/2010 | Clark | B01D 53/38 422/171 |
| 8,192,688 | B2 * | 6/2012 | Hagen | F23R 3/28 422/129 |
| 10,161,628 | B2 * | 12/2018 | Seeley | F23C 99/006 |
| 10,661,217 | B2 * | 5/2020 | Price | B01D 53/005 |
| 2001/0004075 | A1 * | 6/2001 | Wroe | H05B 6/62 219/680 |
| 2002/0110500 | A1 | 8/2002 | Moore et al. | |
| 2006/0032490 | A1 | 2/2006 | Johnson | |
| 2007/0172399 | A1 * | 7/2007 | Clark | B01D 53/38 422/182 |

FOREIGN PATENT DOCUMENTS

| | | | |
|---|---|---|---|
| CN | 202769674 | U | 3/2013 |
| CN | 103363532 | A | 10/2013 |
| CN | 103697475 | A | 4/2014 |
| CN | 104411931 | A | 3/2015 |
| DE | 4201650 | A1 | 7/1993 |
| GB | 2504335 | A | 1/2014 |
| GB | 2513384 | A | 10/2014 |
| JP | 2005131509 | A | 5/2005 |
| JP | 2007519878 | A | 7/2007 |
| JP | 2009034636 | A | 2/2009 |
| WO | 2004090424 | A2 | 10/2004 |
| WO | 2007144665 | A1 | 12/2007 |
| WO | 2014174239 | A1 | 10/2014 |

OTHER PUBLICATIONS

Taiwanese Office Action dated May 24, 2019 and Search Report dated May 16, 2019 for corresponding Taiwanese application Serial No. 105110083.

British Examination Report dated Sep. 24, 2015 and British Search Report dated Sep. 23, 2015 for corresponding British Application Serial No. GB1505447.1.

British Examination Report dated Sep. 26, 2016 and British Search Report dated Sep. 23, 2016 for corresponding British Application Serial No. GB1604942.1.

PCT International Search Report and Written Opinion dated Sep. 8, 2016 for corresponding PCT Application No. PCT/GB2016/050828.

Notification of Reason for Rejection dated Aug. 19, 2019 for corresponding Japanese Application Serial No. JP2017-551051, 7 pages.

* cited by examiner

RADIANT BURNER

CROSS-REFERENCE OF RELATED APPLICATION

This application is a Section 371 National Stage Application of International Application No. PCT/GB2016/050828, filed Mar. 23, 2016, which is incorporated by reference in its entirety and published as WO 2016/156813 A1 on Oct. 6, 2016 and which claims priority of British Application Nos. GB1505447.1, filed Mar. 30, 2015 and GB1604942.1, filed Mar. 23, 2016.

FIELD

The present invention relates to a radiant burner and method.

BACKGROUND

Radiant burners are known and are typically used for treating an effluent gas stream from a manufacturing processing tool used in, for example, the semiconductor or flat panel display manufacturing industry. During such manufacturing, residual perfluorinated compounds (PFCs) and other compounds exist in the effluent gas stream pumped from the process tool. PFCs are difficult to remove from the effluent gas and their release into the environment is undesirable because they are known to have relatively high greenhouse activity.

Known radiant burners use combustion to remove the PFCs and other compounds from the effluent gas stream. Typically, the effluent gas stream is a nitrogen stream containing PFCs and other compounds. A fuel gas is mixed with the effluent gas stream and that gas stream mixture is conveyed into a combustion chamber that is laterally surrounded by the exit surface of a foraminous gas burner. Fuel gas and air are simultaneously supplied to the foraminous burner to affect flameless combustion at the exit surface, with the amount of air passing through the foraminous burner being sufficient to consume not only the fuel gas supply to the burner, but also all the combustibles in the gas stream mixture injected into the combustion chamber.

Although techniques exist for processing the effluent gas stream, they each have their own shortcomings. Accordingly, it is desired to provide an improved technique for processing an effluent gas stream.

The discussion above is merely provided for general background information and is not intended to be used as an aid in determining the scope of the claimed subject matter. The claimed subject matter is not limited to implementations that solve any or all disadvantages noted in the background.

SUMMARY

According to a first aspect, there is provided a radiant burner for treating an effluent gas stream from a manufacturing processing tool, comprising: a porous sleeve at least partially defining a treatment chamber and through which treatment materials pass for introduction into the treatment chamber; and an electrical energy device coupled with the porous sleeve and operable to provide electrical energy to heat the porous sleeve which heats the treatment materials as they pass through the porous sleeve into the treatment chamber.

The first aspect recognizes that known radiant burners typically utilise fuel gas and air in order to provide combustion within the treatment chamber to raise the temperature within the treatment chamber sufficiently to remove the compounds from the effluent gas stream. This requires the provision of a fuel gas, which may not be readily available or which may be undesirable in some processing environments.

Accordingly, a radiant burner or radiant treatment apparatus is provided. The burner may treat an effluent gas stream provided by a manufacturing processing tool. The burner may comprise a porous or foraminous sleeve which defines at least part of a treatment chamber. The porous sleeve may allow treatment materials to pass therethrough and into the treatment chamber. The burner may also comprise an electrical energy device. The electrical energy device may be coupled with the porous sleeve. The electrical energy device may provide electrical energy which heats the porous sleeve. The heated porous sleeve may heat the treatment materials as they pass or are conveyed through the porous sleeve into the treatment chamber. In this way, electrical energy, rather than combustion, can be used to raise the temperature within the treatment chamber in order to treat the effluent gas stream. This provides for greater flexibility in the use of such burners since the burner can be used in environments where no fuel gas exists or where the provision of fuel gas is considered undesirable. Also, heating the treatment materials as they pass through the porous sleeve, rather than simply using radiant heat to heat the treatment chamber enables significantly more energy to be imparted into the treatment materials as they transit through the porous sleeve.

In one embodiment, the porous sleeve has a porosity of between 80% and 90%.

In one embodiment, the porous sleeve has a pore size of between 200 μm and 800 μm.

In one embodiment, the porous sleeve comprises an annular sleeve defining a cylindrical treatment chamber therewithin. Accordingly, the radiant burner may have a treatment chamber whose internal geometry is configured to be identical to existing combustion chambers.

In one embodiment, the porous sleeve comprises at least one of an electrically conductive, a ceramic and a dielectric material. The material used for the porous sleeve may vary, dependent upon the mechanism used to heat the porous sleeve.

In one embodiment, the porous sleeve comprises a sintered metal.

In one embodiment, the sintered metal comprises at least one of fibres, powder, granules.

In one embodiment, the porous sleeve comprises a woven metallic cloth.

In one embodiment, the electrical energy device comprises at least one of a radio-frequency power supply, an electrical power supply and a microwave generator. Accordingly, the electrical energy device may vary, dependent upon the mechanism used to heat the material selected for the porous sleeve.

In one embodiment, the electrical energy device comprises a coupling coupled with the porous sleeve, the coupling comprising at least one of a radio-frequency conductor, an electrical conductor and a waveguide. Accordingly, the coupling which couples the electrical energy device with the porous sleeve may vary, dependent upon the type of energy being conveyed from that electrical energy device to the porous sleeve.

In one embodiment, the at least one of the radio-frequency conductor, the electrical conductor and the waveguide is located within a plenum through which the treatment materials pass, the plenum surrounding the porous sleeve.

Accordingly, the coupling may be located within the plenum which surrounds the porous sleeve and from which the treatment materials are provided. This conveniently reuses an existing void to locate the coupling adjacent the porous sleeve in order to maximize energy transfer to that porous sleeve.

In one embodiment, the at least one of the radio-frequency conductor, the electrical conductor and the waveguide extend over the porous sleeve to heat across its area. Accordingly, the coupling may cover or spread out over the porous sleeve to heat the whole or desired parts of its area.

In one embodiment, the radio frequency power supply provides radio frequency electrical energy using the radio frequency conductor to inductively heat the conductive material. Accordingly, the porous sleeve may be heated using inductive heating.

In one embodiment, the radio frequency electrical energy has a frequency of one of between 500 Hz and 500 KHz, between 20 KHz and 50 KHz and around 30 KHz.

In one embodiment, the radio frequency conductor is located proximate the conductive material. Hence, the conductor may be located adjacent the conductive material in order to facilitate the inductive heating.

In one embodiment, the porous sleeve is cylindrical and the radio frequency conductor coils around the porous sleeve. Accordingly, the conductor may wrap around the porous sleeve.

In one embodiment, the radio frequency conductor is hollow to receive a cooling fluid to cool the radio frequency conductor. Utilizing a hollow conductor enables the cooling fluid to be received within that conductor in order to control its temperature and so reduce losses, which improves the efficiency of the inductive heating.

In one embodiment, the cooling fluid has a conductivity of no more than 100 μS.

In one embodiment, the burner comprises a humidifier operable to provide humidified air as the treatment materials and wherein the cooling fluid is circulated through the humidifier to heat water provided to the humidifier. Accordingly, the heat extracted by the cooling fluid may be reused to heat water provided to the humidifier in order to reduce the energy consumption of the humidifier.

In one embodiment, the water provided to the humidifier comprises at least some of the cooling fluid. Reusing the cooling fluid as the water further improves the heating efficiency and reduces the power consumption of the humidifier.

In one embodiment, the cooling fluid is maintained at a higher than ambient temperature. Maintaining the cooling fluid at a higher than ambient temperature helps to minimize the likelihood of condensation within the plenum.

In one embodiment, the electrical power supply provides electrical energy using the electrical conductor to heat the ceramic material. Accordingly, the porous sleeve may be heated using resistive heating.

In one embodiment, the microwave generator provides microwave energy using the waveguide to heat the dielectric material. Accordingly, the porous sleeve may be heated using microwave energy.

In one embodiment, the dielectric material comprises silicon carbide.

In one embodiment, the microwave energy has a frequency of one of 915 MHz and 2.45 GHz. Operating around the 2.45 GHz range provides for a smaller arrangement, although this is less energy-efficient than operating at the 915 MHz range.

In one embodiment, the burner comprises a porous thermal insulator through which the treatment material pass, the porous thermal insulator being provided in the plenum between the porous sleeve and the electrical energy device. Placing a thermal insulator around the porous sleeve helps to insulate the porous sleeve, which reduces the ambient temperature within the plenum, helps protect the coupling and increases the temperature within the treatment chamber.

In one embodiment, the burner comprises a thermal insulator surrounding the plenum. Providing a thermal insulator which surrounds the plenum also helps to minimize condensation.

In one embodiment, the plenum is defined by a non-ferromagnetic material. Providing a structure made of non-ferromagnetic material which defines the plenum helps to reduce inductive coupling away from the porous material and into the materials which provide the plenum, thereby improving the heating efficiency of the porous sleeve.

According to a second aspect, there is provided a method of treating an effluent gas stream from a manufacturing processing tool, comprising: passing materials through a porous sleeve for introduction into a treatment chamber, the porous sleeve at least partially defining the treatment chamber; and heating the treatment materials as they pass through the porous sleeve into the treatment chamber by heating the porous sleeve using electrical energy from an electrical energy device coupled with the porous sleeve.

In one embodiment, the porous sleeve has at least one of a porosity of between 80% and 90% and a pore size of between 200 μm and 800 μm.

In one embodiment, the porous sleeve comprises an annular sleeve defining a cylindrical treatment chamber therewithin.

In one embodiment, the porous sleeve comprises at least one of an electrically conductive, a ceramic and a dielectric material.

In one embodiment, the porous sleeve comprises a sintered metal.

In one embodiment, the sintered metal comprises at least one of fibres, powder, granules.

In one embodiment, the porous sleeve comprises a woven metallic cloth.

In one embodiment, the electrical energy device comprises at least one of a radio-frequency power supply, an electrical power supply and a microwave generator.

In one embodiment, the method comprises coupling the electrical energy device with the porous sleeve using at least one of a radio-frequency conductor, an electrical conductor and a waveguide.

In one embodiment, the method comprises locating the at least one of the radio-frequency conductor, the electrical conductor and the waveguide within a plenum through which the treatment materials pass, the plenum surrounding the porous sleeve.

In one embodiment, the at least one of the radio-frequency conductor, the electrical conductor and the waveguide extend over the porous sleeve to heat across its area.

In one embodiment, the heating comprises providing radio frequency electrical energy from the radio frequency power supply using the radio frequency conductor to inductively heat the conductive material.

In one embodiment, the radio frequency electrical energy has a frequency of one of between 500 Hz and 500 KHz, between 20 KHz and 50 KHz and around 30 KHz.

In one embodiment, the method comprises locating the radio frequency conductor proximate the conductive material.

In one embodiment, the porous sleeve is cylindrical and the radio frequency conductor coils around the porous sleeve.

In one embodiment, the radio frequency conductor is hollow and the method comprises receiving a cooling fluid within the radio frequency conductor to cool the radio frequency conductor.

In one embodiment, the cooling fluid has a conductivity of no more than 100 μS.

In one embodiment, the method comprises providing humidified air as the treatment materials from a humidifier and circulating the cooling fluid through the humidifier to heat water provided to the humidifier.

In one embodiment, the method comprises providing at least some of the cooling fluid to the humidifier as the water.

In one embodiment, the method comprises maintaining the cooling fluid at a higher than ambient temperature.

In one embodiment, the heating comprises providing electrical energy from the electrical power supply using the electrical conductor to heat the ceramic material.

In one embodiment, the heating comprises providing microwave energy from the microwave generator using the waveguide to heat the dielectric material.

In one embodiment, the dielectric material comprises silicon carbide.

In one embodiment, the microwave energy has a frequency of one of 915 MHz and 2.45 GHz.

In one embodiment, the method comprises passing the treatment material through a porous thermal insulator, the porous thermal insulator being provided in the plenum between the porous sleeve and the electrical energy device.

In one embodiment, the method comprises surrounding the plenum with a thermal insulator.

In one embodiment, the method comprises defining the plenum using a non-ferromagnetic material.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DESCRIPTION OF THE EMBODIMENTS

Before discussing the embodiments in any more detail, first an overview will be provided. Embodiments provide for an electrically-powered radiant burner, which enables an effluent gas stream from a manufacturing processing tool to be treated in situations where providing a fuel gas to raise the temperature of the treatment chamber is undesirable or simply not possible. Unlike traditional radiant heaters, which are unable to obtain the required power density, electrical energy is provided to heat treatment materials as they pass through the porous sleeve into the treatment chamber by heating the porous sleeve which considerably increases the power density and the achievable temperature within the treatment chamber.

Figure 1:
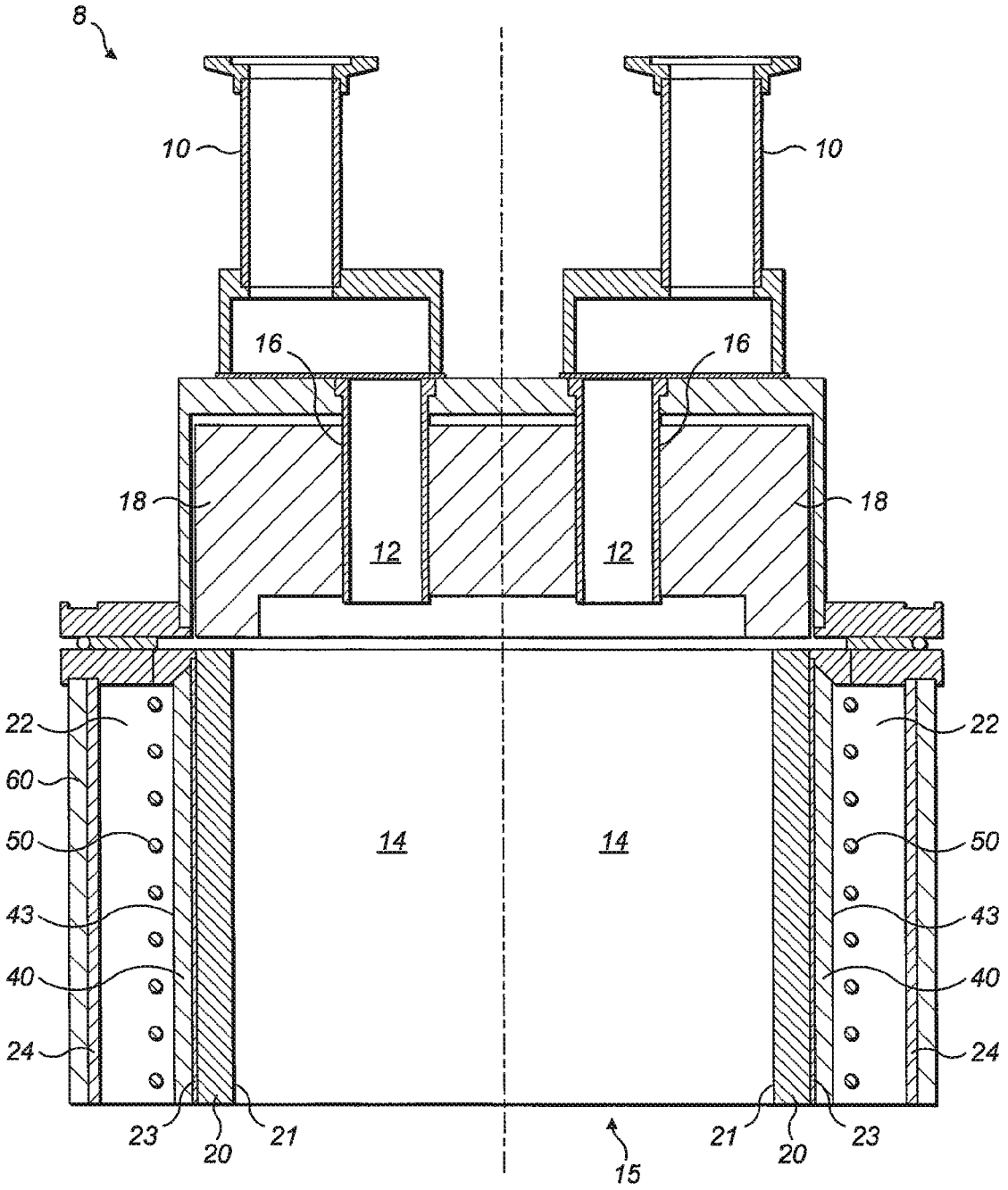
FIG. 1 is a sectional view through a radiant burner assembly according to one embodiment.
Figure 2:
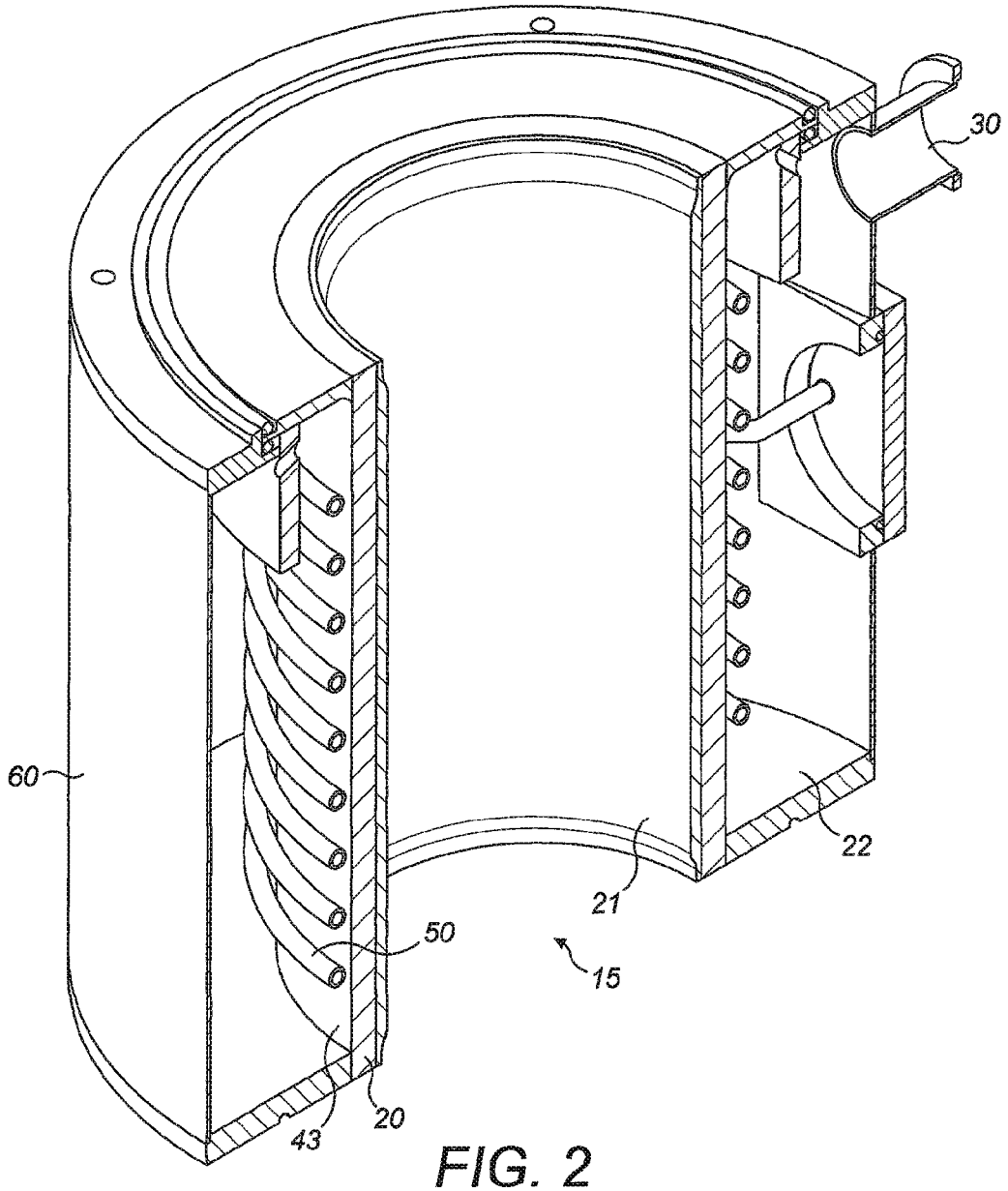
FIG. 2 is a sectional perspective view of features of a radiant burner in more detail with an inlet assembly removed.
Figure 3:
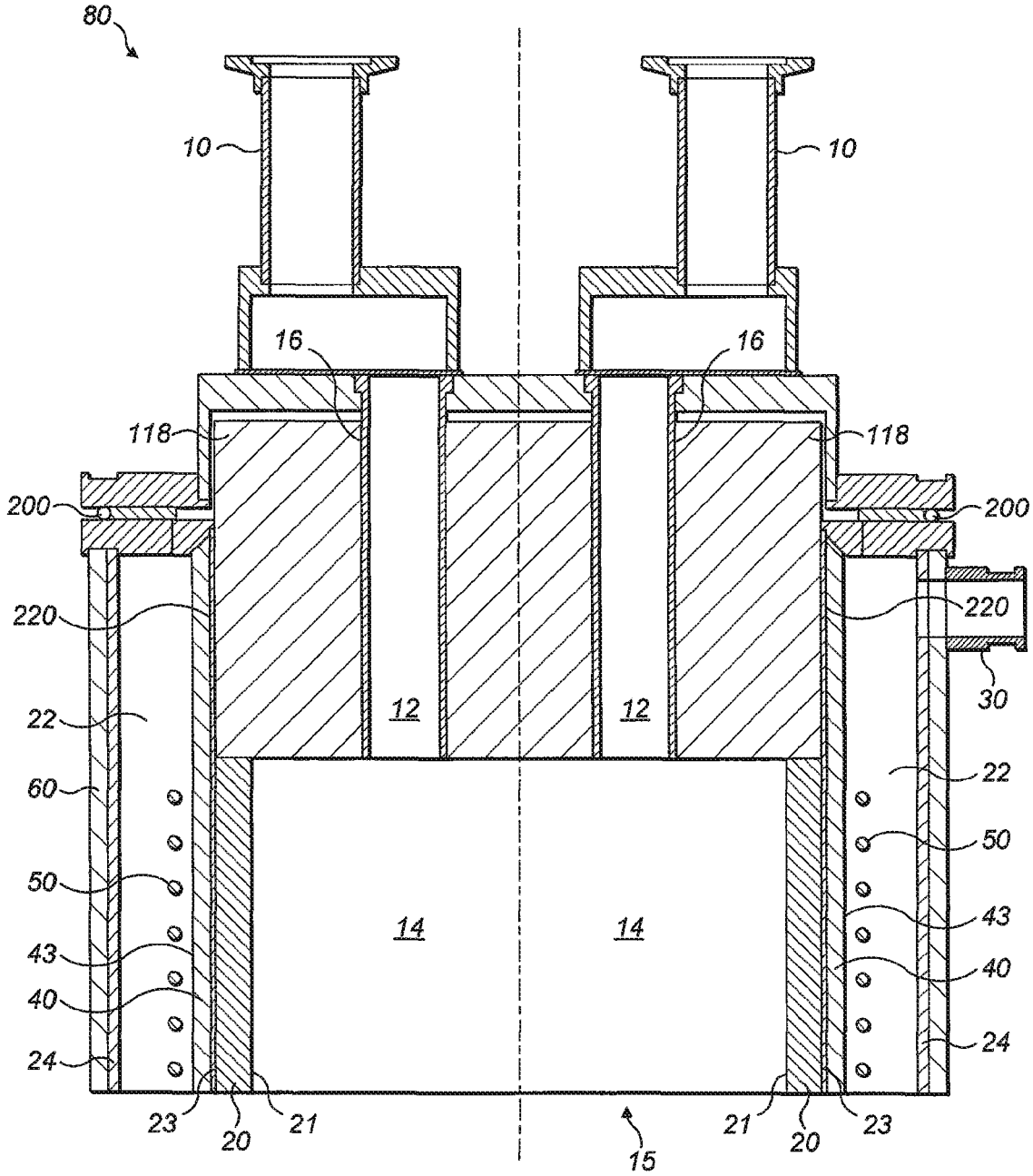
FIG. 3 is a sectional view through a radiant burner according to a further embodiment.

FIG. 1 is a cross section through a radiant burner assembly, generally 8, according to one embodiment. FIG. 2 illustrates features of the radiant burner in more detail with an inlet assembly removed. In this embodiment, electrical energy is supplied using inductive heating, although it will be appreciated that other heating mechanisms such as microwave heating or resistive heating are possible. FIG. 3 is a cross section through a radiant burner assembly, generally 80, according to a further embodiment with the inlet assembly in place. In this embodiment electrical energy is again supplied using inductive heating, although alternative heating mechanism, such as microwave heating or resistive heating are possible.

The radiant burner assemblies 8, and 80, treat an effluent gas stream pumped from a manufacturing process tool such as a semiconductor or flat panel display process tool, typically by means of a vacuum-pumping system. The effluent stream is received at inlets 10. The effluent stream is conveyed from the inlet 10 to a nozzle 12 which injects the effluent stream into a cylindrical treatment chamber 14. In this embodiment, the radiant burner assembly 8, 80 comprise four inlets 10 arranged circumferentially, each conveying an effluent gas stream pumped from a respective tool by a respective vacuum-pumping system. Alternatively, the effluent stream from a single process tool may be split into a plurality of streams, each one of which is conveyed to a respective inlet. Each nozzle 12 is located within a respective bore 16 formed in a ceramic top plate 18, 118, which define an upper or inlet surface of the treatment chamber 14.

The treatment chamber 14 has side walls defined by an exit surface 21 of a foraminous sleeve 20 in the form of a cylindrical tube. The foraminous sleeve 20 is made of a material which is suitable for the selected mode of heating. In this embodiment, inductive heating is used and so the foraminous sleeve 20 comprises a porous metal, for example sintered metal fibre, of a heat-resisting alloy, such as Fecralloy® (Chromium, 20-22%; Aluminum, 5%; Silicon, 0.3; Manganese, 0.2-0.08%, Yttrium, 0.1%; Zirconium, 0.1%, Carbon, 0.02-0.03%; and the balance being Iron); stainless stesl grade 314 (Carbon 0.25% max, Manganese 2% max, Silicon 1.5-3%, Phosphorous 0.045% max, Sulphur 0.03% max, Chromium 23.0-26.0, Nickel 19.0-22.0, and the balance being Iron); or Inconel 600® (Ni minimum 72.0%, Cr 15.5%, Fe 8.0% Mn 1.0% C 0.15% Cu 0.5% Si 0.5% S 0.015%)

The foraminous sleeve 20 is cylindrical and is retained concentrically within an insulating sleeve 40. The insulating sleeve 40 is a porous ceramic tube, for example, an alumina tube which may be formed by sintering an alumina slip which has been used to coat a reticulated polyurethane foam. Alternatively, the insulating sleeve 40 may be a rolled blanket of ceramic fibre. The insulating sleeve 40 helps to elevate the temperature within the treatment chamber 14 by reducing heat loss and also helps to reduce the temperature within the plenum 22 which in turn reduces the temperature of the components used for inductive heating to improve their efficiency.

The porous ceramic tube and the foraminous sleeve 20 are typically 80% to 90% porous, with a pore size between 200 μm and 800 μm.

A plenum volume 22 is defined between an entry surface 43 of the insulating sleeve 40 and a cylindrical outer shell 24. The plenum volume 22 is beneficially enclosed using non-ferromagnetic materials in order to reduce inductive coupling. In addition, the cylindrical outer shell 24 is concentrically enclosed within an outer insulating sleeve 60 in order to reduce the outer surface temperature to safe levels should the temperature of the cylindrical outer shell 24 become raised due, for example, to stray heating.

A gas is introduced into the plenum volume 22 via an inlet nozzle 30. The gas may be air, or a blend of air and other species such as water vapour, $CO_2$. In this example, humidified air is introduced and the humidified air passes from the entry surface 23 of the insulating sleeve 40 to the exit surface 21 of the foraminous sleeve 20.

In this embodiment, an inductive heating mechanism is used and so the plenum volume 22 also contains a work coil 50 connected to a radio-frequency (RF) power supply (not shown) for heating the foraminous sleeve 20 by RF induction. The work coil 50 is typically a coiled copper hollow tube, cooled by circulation of a cooling fluid, for example water, with a low electrical conductivity, for example <100 μS. If the supplied air is enriched with water vapour, then it may be beneficial to operate the cooling fluid at an elevated temperature so as to avoid condensation on the work coil 50. This may be achieved conveniently by use of a closed-loop circuit. As mentioned above, the insulating sleeve 40 serves as a thermal insulator to protect the work coil 50.

Electrical energy supplied to the foraminous sleeve 20 heats the foraminous sleeve 20. This in turn heats the humidified air as it passes from an entry surface 23 of the foraminous sleeve 20 to the exit surface 21 of the foraminous sleeve 20. In addition, the heat generated by the foraminous sleeve 20 raises the temperature within the treatment chamber 14. The amount of electrical energy supplied to the foraminous sleeve 20 is varied to vary the nominal temperature within the treatment chamber 14 to that which is appropriate for the effluent gas stream to be treated. For example, the foraminous sleeve 20 (having an example diameter of 150 mm and an example length of 300 mm) is heated to between 800° C. and 1200° C. and the humidified air is likewise heated to this temperature. This is achieved by supplying electrical energy at a level of typically between around 10 kW and 20 kW applied to the foraminous sleeve 20 having the above example dimensions. This provides for a foraminous sleeve 20 surface area of $\pi \times 0.15 \times 0.3 = 0.14\ m^2$ and an equivalent power density of between around 70 $kWm^{-2}$ and 140 $kWm^{-2}$. The applied power is related to the flow rate of air through the foraminous sleeve 20. In this example, the air flow would be of the order of between around 300 l/min and 600 l/min. One skilled in the art would recognise that other conditions of power, air flow and temperature are possible. Typically, the radio frequency electrical energy has a frequency of between 500 Hz and 500 KHz, preferably between 20 KHz and 50 KHz and more preferably around 30 KHz. The effluent gas stream containing noxious substances to be treated is caused to mix with this hot gas in a known manner in the treatment chamber 14. The exhaust 15 of the treatment chamber 14 is open to enable the combustion products to be output from the radiant burner assembly 8 and received typically by a water weir (not shown) in accordance with known techniques.

The further embodiment illustrated in FIG. 3 has an elongated top plate 118 which extends into the volume defined by a non-porous, non-ferromagnetic upper wall portion 220 of the sleeve 20. In this embodiment the work coils 50 and porous portion of the sleeve 20 are located distal from the seal 200. By locating the work coils at a suitable distance from the sealing surface comprising the seal 200 it is protected from heat generated by the work coil in the porous sleeve 20 transmitting to, and degrading, it. Locating the gas inlet 30 proximate to the surface comprising the seal 200, into the portion of the plenum 22 defined by the upper portion 220 of the sleeve 20 and the outer shell 24 also provides a further degree of protection for the seal 200 due to passage of gas across the surfaces thereof.

Accordingly, it can be seen that the effluent gas received through the inlets 10 and provided by the nozzles 12 to the treatment chamber 14 is treated within the treatment chamber 14, which is heated by the foraminous sleeve 20. The humidified air provides products, such as oxygen (typically with a nominal range of 7.5% to 10.5%), as well as water (typically with a nominal range of 10% to 14%, and preferably 12%), depending whether or not oxygen enrichment occurs and on the humidity of the air, to the treatment chamber 14. The heat breaks down and/or the products react with the effluent gas stream within the treatment chamber 14 to clean the effluent gas stream. For example, $SiH_4$ and $NH_3$ may be provided within the effluent gas stream, which reacts with $O_2$ within the treatment chamber 14 to generate $SiO_2$, $N_2$, $H_2O$, $NO_x$. Similarly, $N_2$, $CH_4$, $C_2F_6$ may be provided within the effluent gas stream, which reacts with $O_2$ within the treatment chamber 14 to generate $CO_2$, HF, $H_2O$. Likewise, $F_2$ may be provided within the effluent gas stream, which reacts with $H_2O$, HF, $H_2O$ within the treatment chamber 14 to generate HF, $H_2O$.

Accordingly, embodiments provide a method and apparatus to combustively destroy waste gases from semiconductor-like processes utilising an RF induction heated porous—wall combustion chamber.

High power indirect heating is possible by induction heating. Providing the susceptor as a porous metal tube allows for the possibility of mimicking radiant burner combustion systems by allowing gas to be passed through and heated to a high temperature. This opens a way of giving burner-like performance with an electrical system.

Embodiments can be varied to reflect the various nozzle and inject strategies employ in existing burners. The radiant burner element may be un-sintered ceramic fibre or, beneficially, sintered metallic fibre.

In embodiments, microwave or resistive heating is used to heat the foraminous sleeve 20. In the case of microwave heating, a microwave generator is provided which couples with a waveguide located in the plenum volume 20 which conveys microwave energy to the foraminous sleeve 20 which is formed of a dielectric material. In the case of resistive heating, a power supply is provided which couples with a conductor located in the plenum volume 20 which conveys electrical energy to the foraminous sleeve 20 which is formed of a ceramic material.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A radiant burner for treating an effluent gas stream from a manufacturing processing tool, comprising:

a porous sleeve at least partially defining a treatment chamber and through which treatment materials pass for introduction into said treatment chamber; and an electrical energy device coupled with said porous sleeve and operable to provide electrical energy to said porous sleeve such that the porous sleeve generates heat from the electrical energy through one of inductive heating, resistive heating and microwave heating, wherein the generated heat heats said treatment materials as they pass through said porous sleeve into said treatment chamber.

2. The radiant burner of claim 1, wherein said porous sleeve comprises at least one of an electrically conductive, a ceramic and a dielectric material.

3. The radiant burner of claim 1, wherein said porous sleeve comprises one of a sintered metal and a woven metallic cloth.

4. The radiant burner of claim 1, wherein said electrical energy device comprises at least one of a radio-frequency power supply, an electrical power supply and a microwave generator.

5. The radiant burner of claim 1, wherein said electrical energy device comprises a coupling coupled with said porous sleeve, said coupling comprising at least one of a radio-frequency conductor, an electrical conductor and a waveguide.

6. The radiant burner of claim 5, wherein said at least one of said radio-frequency conductor, said electrical conductor and said waveguide is located within a plenum through which said treatment materials pass, said plenum surrounding said porous sleeve.

7. The radiant burner of claim 5, wherein said at least one of said radio-frequency conductor, said electrical conductor and said waveguide extend over said porous sleeve to heat across its area.

8. The radiant burner of claim 4, wherein said radio frequency power supply provides radio frequency electrical energy using said radio frequency conductor to inductively heat said conductive material.

9. The radiant burner of claim 8, wherein said radio frequency electrical energy has a frequency of one of between 500 Hz and 500 KHz, between 20 KHz and 50 KHz and around 30 KHz.

10. The radiant burner of claim 5, wherein said porous sleeve is cylindrical and said radio frequency conductor coils around said porous sleeve.

11. The radiant burner of claim 5, wherein said radio frequency conductor is hollow to receive a cooling fluid to cool said radio frequency conductor.

12. The radiant burner of claim 11, comprising a humidifier operable to provide humidified air as said treatment materials and wherein said cooling fluid is circulated through said humidifier to heat water provided to said humidifier.

13. The radiant burner of claim 11, wherein said water provided to said humidifier comprises at least some of said cooling fluid.

14. The radiant burner of claim 1, comprising a porous thermal insulator through which said treatment material pass, said porous thermal insulator being provided in a plenum between said porous sleeve and said electrical energy device.

15. A method of treating an effluent gas stream from a manufacturing processing tool, comprising:

passing materials through a porous sleeve for introduction into a treatment chamber, said porous sleeve at least partially defining said treatment chamber; and heating said treatment materials as they pass through said porous sleeve into said treatment chamber by supplying electrical energy to the porous sleeve so that the porous sleeve generates heat from the electrical energy using one of inductive heating, resistive heating and microwave heating, wherein the electrical energy is supplied to the porous sleeve by an electrical energy device coupled with said porous sleeve.

* * * * *